United States Patent [19]

Petrie et al.

[11] 4,170,209

[45] Oct. 9, 1979

[54] IGNITION DWELL CIRCUIT FOR AN INTERNAL COMBUSTION ENGINE

[75] Inventors: Adelore F. Petrie, Arlington Heights; Rupin J. Javeri, Elk Grove Village, both of Ill.

[73] Assignee: Motorola, Inc., Schaumburg, Ill.

[21] Appl. No.: 905,260

[22] Filed: May 12, 1978

[51] Int. Cl.[2] ..... F02P 5/00

[52] U.S. Cl. ..... 123/148 E; 123/117 R

[58] Field of Search ..... 123/148 E, 117 R, 146.5 A; 315/209 TZ

[56] References Cited

U.S. PATENT DOCUMENTS

| | | | |
|---|---|---|---|
| 3,943,896 | 3/1976 | Green et al. | 123/148 E |
| 4,102,310 | 7/1978 | Caron | 123/117 R |
| 4,106,440 | 8/1978 | Lai et al. | 123/117 R |

FOREIGN PATENT DOCUMENTS

| | | | |
|---|---|---|---|
| 2456580 | 6/1975 | Fed. Rep. of Germany | 123/148 E |
| 2505649 | 9/1975 | Fed. Rep. of Germany | 123/148 E |
| 2524043 | 12/1975 | Fed. Rep. of Germany | 123/148 E |

*Primary Examiner*—Charles J. Myhre
*Assistant Examiner*—P. S. Lall
*Attorney, Agent, or Firm*—James W. Gillman; Melvin A. Klein; Phillip H. Melamed

[57] ABSTRACT

Electronic signal processing circuitry for use in the ignition system of an internal combustion engine is disclosed herein. A signal generator which receives crankshaft position pulses from a sensor and produces periodic output pulses which have durations equal to a constant percentage of the period of the input sensor pulses is disclosed. The generator includes a crankshaft position sensor feeding a bistable flip-flop which controls a dual slope integrator circuit having its output coupled to a comparator with the comparator output coupled back to the reset terminal of the flip-flop. The generator produces pulses at the output of the flip-flop which have durations equal to a constant percentage of the period of the crankshaft position sensor pulses. The dual slope integrator circuit produces a periodic ramp (sawtoothed) signal which is processed by a clamping circuit and a comparator to produce an ignition dwell pulse which occurs a fixed time before the occurrence of the crankshaft position sensor pulses. An engine speed monitoring circuit also receives the periodic varying ramp signal produced by the dual slope integrator and via sampling circuitry produces an output signal related to engine speed whose magnitude is updated during each cycle of the crankshaft position pulses.

8 Claims, 5 Drawing Figures

IGNITION DWELL CIRCUIT FOR AN INTERNAL COMBUSTION ENGINE

CROSS-REFERENCE TO RELATED APPLICATIONS

The subject matter of the present invention is related to the subject matter contained in a copending U.S. patent application entitled, "Engine Speed Monitoring Circuit", by Rupin J. Javeri, Ser. No. 905,253 filed May 12, 1978, which is assigned to Motorola, Inc. The copending application illustrates another use for the waveforms generated by the circuitry shown in FIGS. 1 and 2 of the present application.

BACKGROUND OF THE INVENTION

The present invention generally relates to the field of electrical signal processing circuitry, and more particularly to the use of such circuitry for controlling the dwell and spark ignition in an ignition system for an internal combustion engine.

It has been recognized that the present day mechanical ignition systems for automobiles and similar vehicles cannot meet the requirement for reliably controlling the spark timing and dwell of an internal combustion engine over the estimated lifetime of the engine. Thus many prior art solid state ignition systems have been proposed for electronically controlling the dwell and spark ignition of an internal combustion engine and thereby conserving fuel and reducing pollution by increasing the efficiency of the engine.

Generally, most prior art electronic ignition systems utilize a crankshaft position sensor for synchronizing developed electronic control signals to predetermined positions of the engine crankshaft. However, generally the accuracy of the prior art electronic ignition systems is severely dependent upon the duty cycle of the crankshaft position sensor signal. Since the duty cycle of the sensor signal (the ratio of one logic state produced by the sensor to the period of the sensor signal) may vary substantially under certain engine conditions, the prior art electronic ignition systems have been unable to utilize the sensor signal to accurately control the dwell and spark timing of the engine with the precision which is desired.

In addition, most prior art electronic ignition systems are unable to initiate dwell at a precise time before the occurrence of a crankshaft sensor position pulse. The prior art systems have also generally been unable to accurately monitor the engine speed and update this speed monitoring information during each crankshaft rotation.

Thus while the prior art electronic ignition systems have avoided some of the disadvantages of the mechanical ignition systems caused by the wearing out of mechanical parts, the accuracy of prior art electronic ignition systems leaves much to be desired.

SUMMARY OF THE INVENTION

Accordingly, it is an object of the present invention to provide an improved signal processing circuit adaptable for use with the ignition system of an internal combustion engine.

It is a further object of the present invention to provide an improved ignition dwell circuit for internal combustion engine whereby dwell pulses can be generated which occur at a precise time before the occurrence of engine crankshaft sensing pulses.

In one embodiment of the present invention an improved ignition dwell circuit for an internal combustion engine is provided. The circuit comprises: sensor means for producing a sensor signal having periodic pulses occurring at predetermined rotational positions of an engine crankshaft; means coupled to said sensor means for receiving said sensor signal pulses and producing, in response thereto, a ramp signal changing at a predetermined rate immediately prior to and reaching a variable peak magnitude at the occurrence of each of said periodic pulses; clamp means for receiving said ramp signal and producing a corresponding similarly varying clamped ramp signal having a corresponding clamped peak magnitude clamped to a first predetermined reference level; and comparator means coupled to said clamp means for receiving said clamped signal and comparing it to a second predetermined reference level which is offset from said first predetermined reference level: wherein said clamped signal equals said second reference level a fixed time before the occurrence of said clamped peak magnitude and said comparator produces a pulse in response thereto, whereby said comparator pulses occur a fixed time before said predetermined rotational positions of the engine crankshaft and can be used to initiate the dwell time for an internal combustion engine.

Basically, the ignition dwell circuit comprises a crankshaft position sensor which feeds a circuit that produces a ramp waveform in which the waveform reaches a variable peak magnitude at the occurrence of each one of the crankshaft position pulses, this peak magnitude being related to engine speed. A clamp circuit is then used to clamp this waveform such that each of these peak magnitudes will be normalized to the same reference level magnitude. Then a comparator is used to compare this clamped signal to a reference level that is slightly less than the clamped peak magnitude level. Since the waveform is varying at a constant predetermined rate immediately prior to the peak magnitude, when the comparator determines that the waveform magnitude is equal to the second reference level, the comparator will produce a pulse transition at a constant time before the occurrence of the crankshaft position pulse, which corresponds in its time occurrence to the peak of the generated ramp waveform. Two embodiments for the clamping circuit are illustrated herein and each specific embodiment essentially utilizes the crankshaft position pulses in a gating manner to insure the proper operation of the clamping circuit.

BRIEF DESCRIPTION OF THE DRAWINGS

For a more complete understanding of the invention reference should be made to the drawings, in which.

DESCRIPTION OF THE PREFERRED EMBODIMENT

Figure 1:
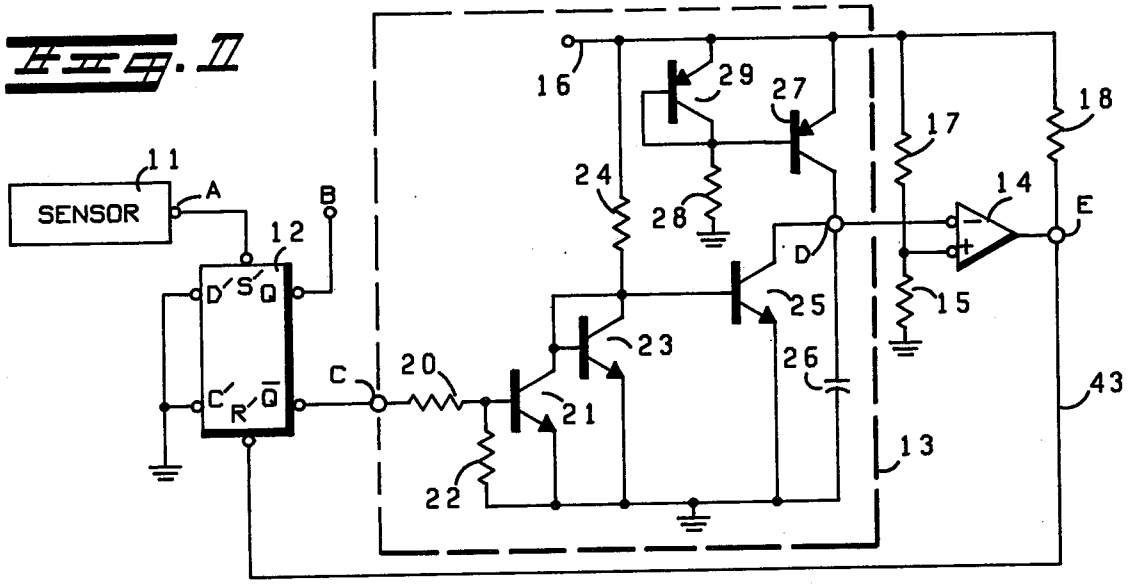
FIG. 1 is a schematic diagram of a signal generator adaptable for use in an ignition system in which periodic output pulses are produced having durations equal to a precise percentage of the period of an input signal.

Referring now to FIG. 1, a signal generator 10 is illustrated which receives a periodic input signal and produces periodic output pulses that have durations equal to a precise percentage of the input signal period. The signal generator 10 basically comprises an input sensor 11, a D-type flip-flop circuit 12 connected as an S-R flip-flop, a dual slope integrating circuit 13 (shown dashed) and a voltage comparator 14.

Preferably, the signal generator 10 is intended for use in the ignition system of an internal combustion engine and the sensor 11 corresponds to a crankshaft position sensor for producing periodic input pulses having leading and trailing edges at an output terminal A, wherein the period of these input pulses is variable and related (inversely proportional) to the rotational speed of the crankshaft of the engine since the occurrence of these pulses is determined by predetermined rotational positions of the engine crankshaft (not shown). The sensor 11 can be either a magnetic sensor or, preferably, a Hall effect sensor.

The terminal A of the sensor 11 is directly coupled to a set terminal S′ of the flip-flop 12. Data and clock terminals (D′ and C′, respectively) of the flip-flop are both directly connected to ground potential and a flip-flop output terminal Q is directly connected to an output terminal B while an additional flip-flop output terminal $\overline{Q}$ is directly connected to a terminal C which is the input terminal of the dual slope integrating circuit 13. A terminal D is the output terminal of the dual slope circuit 13 and is directly connected as an input to a negative input terminal of the comparator 14. A positive input terminal of the comparator 14 is connected to ground through a resistor 15 and connected to a positive voltage supply terminal 16 through a resistor 17. A terminal E represents the output terminal of the comparator 14 and is coupled to the positive voltage supply terminal 16 through a resistor 18 and is directly connected to a reset terminal R′ of the flip-flop circuit 12.

Figure 2:
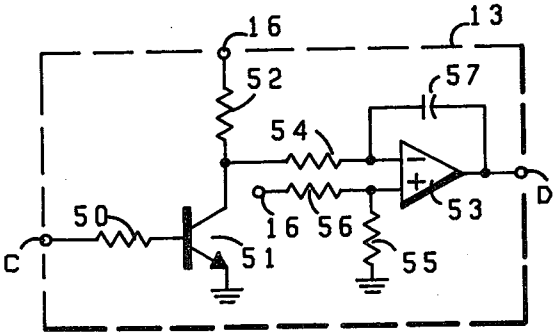
FIG. 2 is a schematic diagram illustrating an alternate embodiment for a portion of the circuit illustrated in FIG. 1.

The dual slope integrating circuit 13, as shown in FIG. 1, comprises a resistor 20 coupled between the terminal C and the base of an NPN transistor 21 which is also connected to ground through a resistor 22. The emitter of the transistor 21 is connected to ground and the transistor's collector is directly connected to both the base and collector electrodes of an NPN transistor 23 which has it emitter directly connected to ground. The collector of transistor 23 is connected to the voltage supply terminal 16 through a resistor 24 and is directly connected to the base of an NPN transistor 25 which has its emitter directly connected to ground and its collector directly to the output terminal D. An integrating capacitor 26 is coupled between the terminal D and ground and a PNP transistor 27 has its collector electrode directly connected to the terminal D and its emitter electrode connected to the terminal 16. The base of the transistor 27 is connected to ground through a resistor 28 and is directly connected to the base and collector electrodes of a PNP transistor 29 which has its emitter directly connected to the terminal 16. The components 20–29 comprise the dual slope integrating circuit 13 shown in FIG. 1. FIG. 2 illustrates another embodiment of the dual slope integrating circuit 13 which has precisely the same input and output operating characteristics.

The operation of the signal generator circuit 10 shown in FIG. 1 will now be described with reference to the signal waveforms illustrated in FIGS. 5A through 5E which directly correspond to the signal waveforms produced at the terminals A–E in FIG. 1, respectively. The waveforms in FIGS. 5A–E represent voltage waveforms wherein the vertical axis represents amplitude and the horizontal axis represents time. A break point 30 is shown in the time axis of these waveforms and the waveforms to the right of the breakpoint represent those signals produced at an engine crankshaft speed which is approximately twice the engine crankshaft speed that produced the waveforms to the left of the breakpoint. In all of the drawings, identical reference numbers and letters are used to identify identical components, terminals signals and reference voltage levels.

Figure 5:
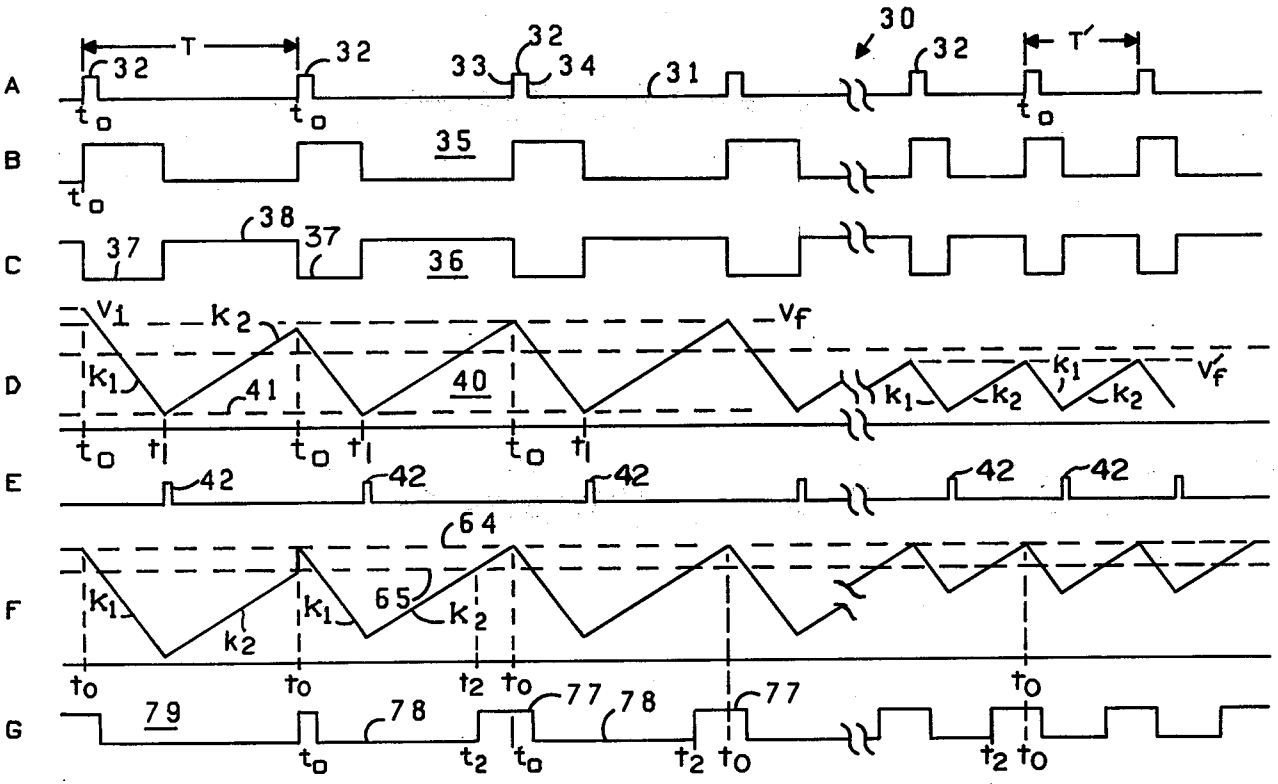
FIGS. 5A–G are graphs illustrating the amplitude of various signals produced by the circuits shown in FIGS. 1–4.

As previously mentioned, the crankshaft position sensor 11 produces a sensor signal designated by the reference number 31 and shown in FIG. 5A. This signal 31 comprises a plurality of variable period input signal pulses 32 wherein each pulse occurs at a predetermined rotational position of the engine crankshaft. Each pulse has a leading edge 33 and a trailing edge 34. FIG. 5A illustrates that the pulses produced to the left of the breakpoint 30 occur at a period T wherein this period is variable and is inversely proportional to the rotational speed of the engine crankshaft. To the right of the breakpoint 30, the signal 31 is illustrated as having a period T′ which represents a higher engine crankshaft rotational speed, approximately twice the rotational speed that created the signal 31 to the left of the breakpoint 30. While FIGS. 5A–E illustrate signals with constant periods to the right and left of the breakpoint 30, it should be noted that the input signal period is related to the engine crankshaft speed and therefore is contemplated as being variable. FIGS. 5A–E are merely shown with two different constant periods to clarify the explanation of the operation of the present invention.

In FIG. 5A each sensor pulse 32 is illustrated as occuring at a time $t_0$, wherein the time from one $t_0$ to the next represents the period T of the signal 31, which as previously mentioned can be created by a Hall effect sensor probe. The pulses 32 are received at the set terminal S′ of the bistable flip-flop circuit 12. FIGS. 5B and 5C illustrate the outputs of the flip-flop circuit 12 at the output terminals Q and $\overline{Q}$, respectively, as well as the signals created at the terminals B and C, respectively. The signal produced at terminal B is designated by the reference number 35 whereas the signal produced at the terminal C is designated by the reference numeral 36. Each signal comprises first and second logic states and the logic states of signal 35 are the inverse of the logic states of signal 36.

In response to each sensor pulse 32 received at the set terminal S′, the flip-flop circuit 12 creates a low logic signal 37 at the terminal C. Subsequently, after precisely one-third of the period T has elapsed, the signal 36 will be switched to a second positive logic state 38 and the signal 36 will retain this second logic state until the next input sensor pulse 32. The manner by which the signal 36 is caused to switch logic states after the elapsing of precisely one-third of the period T will now be discussed.

FIG. 5D illustrates a dual ramp (saw-toothed) signal 40 which represents the voltage at the terminal D which is the voltage maintained at one terminal of the capacitor 26. Initially, at the time $t_0$ the voltage 40 is assumed to be at an initial value $V_i$. In response to the low logic state 37 produced at the terminal C, wherein the low logic state corresponds to ground potential, the transistor 21 is turned off and this results in turning on the transistor 23 and having the transistor 25 discharge the capacitor 26 at a constant predetermined rate. This constant discharging rate is illustrated in FIG. 5D by the linear slope $k_1$ and this rate of discharge is determined by the current passing through the resistor 24, minus any charging current supplied by the transistor 27. This is because the transistor 23 is essentially connected as a diode and the current through the resistor 24 determines the voltage developed by the diode connected transistor 23. Since transistor 25 has its base-emitter junction biased by the voltage developed by the diode connected transistor 23, the transistor 25 will also conduct precisely the same current that is being drawn through the resistor 24. Thus the combination of the components 23 through 25 represents a constant current source that results in discharging the capacitor 26 at a predetermined rate $k_1$ which results in decreasing the voltage across the capacitor, corresponding to the signal 40, at the same rate.

The voltage at the terminal D is monitored by the comparator 14 which compares this voltage to a predetermined first reference level voltage determined by the resistor divider network comprising the resistors 15 and 17. This first reference level voltage corresponds to the voltage at the junction between the resistors 15 and 17 and is illustrated in FIG. 5D by the dashed reference line 41. Until the signal 40 at the terminal D is decreased enough so that its magnitude equals the reference level voltage 41, the output of the comparator 14 at the terminal E will remain constant and at a low level. When the capacitor voltage signal 40 has its magnitude decreased to such an extent that it equals the reference level 41, the comparator 14 will produce a reset pulse 42 as shown in FIG. 5E. This occurs at a time $t_1$ after the time $t_0$. The reset pulse 42 is coupled to the reset terminal R' of the flip-flop 12 by a conductor 43 shown in FIG. 1. This reset pulse switches the logic state of the signal 36 of the terminal C to the second logic state 38. With the signal 36 having a magnitude corresponding to the second logic state 38, which corresponds to a high voltage logic state, this results in turning on the transistor 21. With the transistor 21 turned on, the transistors 23 and 25 will be turned off thereby preventing the discharge of the capacitor 26 by means of the current drawn by the transistor 25.

Whenever the transistor 25 is not discharging the capacitor 26, the transistors 27 and 29 will charge up the capacitor at a constant predetermined rate $k_2$ (slower than the rate $k_1$) determined by the magnitude of the resistor 28. The components 27–29 represent a constant current source which functions identically to the constant current source created by the components 23–25. Thus the signal 40, corresponding to the voltage at the capacitor terminal D, will be increased at a constant predetermined rate determined by the magnitude of the resistor 28 and this constant rate of increase is illustrated in FIG. 5D by a straight line segment having a positive slope $k_2$, whereas the slope $k_1$ had a negative polarity. Since the magnitude of the voltage at the terminal D is now increasing at the rate $k_2$, this results in terminating the pulse 42 produced by the comparator 14 and the magnitude of the signal 40 continues to increase until a crankshaft position pulse 32 is again received at the set terminal S' of the flip-flop 12, which results in recommencing the entire previously described cycle.

Thus essentially a bistable flip-flop circuit 12 is used to produce first and second logic state signals 37 and 38 to control a dual slope rate changing circuit 13 that charges and discharges a capacitor 26 to produce a time varying signal 40 having a magnitude that varies at a first predetermined rate $k_1$ with a negative polarity and then at a second predetermined rate $k_2$ with a positive polarity. A standard DC voltage level comparator 14 is used to monitor the magnitude of the signal 40 and produce reset pulses 42 when this magnitude equals a voltage reference level 41. These reset pulses 42 are coupled to the reset terminal R' of the flip-flop circuit 12 and result in resetting the flip-flop. This reset mode is maintained until a subsequent input pulse 32 is again received at the set terminal S' of the flip-flop.

It has been found that the circuitry illustrated in FIG. 1 and described above is capable of precisely dividing the input period T of the sensor signal 31 into any desired fraction by insuring that the rate $k_2$ has an absolute magnitude less than the rate $k_1$. Or in other words, whenever the rate $k_2$ is a slower rate of change than the rate $k_1$, the circuitry in FIG. 1 will precisely divide the input signal period T and produce a waveform representative of this precise division. This can be seen by analyzing the signal relationships represented by the following four equations.

Positive peak values of the waveform 40 result at the time occurrence $t_0$ of the crankshaft position sensor pulses 32. The magnitude of these positive peaks can be represented by the following equation:

$$V_f=(T-V_{f-1}/k_1)k_2+V_{ref}, \quad (1)$$

where $V_f$ represents the positive peak, T represents the period of the signal 31, $k_1$ and $k_2$ represent the rates of change of the signal 40, $V_{ref}$ is the reference level 41 and $V_{f-1}$ represents the peak value of the signal 40 at the previous occurrence of a crankshaft position pulse 32.

In order to provide for a stable precise division of the period T, the peak value $V_f$ of the signal 40 must converge rapidly to a final value. It can be shown that whenever the rates of change of the signal 40 satisfy the following equation:

$$k_2/k_1<1; \quad (2)$$

then the peak value of the signal 40 will rapidly converge toward a constant value, assuming that the period of the crankshaft position pulses does not change. Under this condition it can be shown that the duration of the logic state 37 of the signal 36 is equal to a precise fraction of the input signal period T. This relationship is illustrated in the following equation:

$$(t_0-t_1)/T=k_2/(k_1+k_2), \quad (3)$$

wherein the quantity $t_0-t_1$ divided by T effectively represents the duty cycle of the waveform 36 and this quantity must be less than one-half due to the restrictions imposed by equation two. From equation three it can be seen that maintaining the rates $k_1$ and $k_2$ at constant values the signal 36 will be produced wherein the duration of the logic state 37 will be a precise constant fraction of the total period T. Since the duty cycle of the signal 36 will be constant, this waveform can now be used by electronic apparatus to accurately control the dwell and spark timing of an internal combustion engine ignition system.

Preferably, the rate (slope) $k_2$ is equal to one-half of the rate (slope) $k_1$. This results in the logic state 37 having a duration equal to one-third of the period T, while the logic state 38 exists for two-thirds of this period. The waveforms shown in FIGS. 5A–E are drawn to scale for such a rate relationship and illustrate that after one cycle (the distance between two sequential sensor pulses 32) the signal 40 has reached a peak value substantially equal to the final peak value $V_f$ and that the duration of the logic state 37 is substantially equal to one-third of the period T.

The waveforms in FIGS. 5A–E to the right of the breakpoint 30 show the signals developed at each of the terminals A–E after several cycles of an input sensor pulse period T′ has existed. For these waveforms the peak values of the signal 40 have now converged to a level $V'_f$ which is less than the value $V_f$ shown to the left of the breakpoint 30. In general, the peak value of the waveform 40 can be represented by the following equation:

$$V_f=(k_2k_1)/(k_1+k_2)\ (T)+V_{ref} \qquad (4)$$

From equation four and FIG. 5D it is clear that the positive peak magnitudes of the signal 40 occur at the occurrence of the input signal sensor pulses 32 (at the times $t_0$) and that the peak magnitudes of the signal 40 are directly proportional to the period of the crankshaft position sensor pulses 32, and therefore inversely proportional to the rotational speed of the engine crankshaft. The fact that the peaks of the signal 40 occur at the occurrence of the crankshaft position sensor pulses 32 and that the signal varies at a known rate prior to these peaks permits the use of the waveform 40 to generate dwell pulses which can be initiated at a constant precise time before the occurrence of the crankshaft pulses 32, regardless of the engine speed. Subsequently, apparatus will be described which accomplishes the results mentioned in the preceding sentence.

FIG. 2 merely illustates another embodiment of the dual slope rate changing circuit 13 shown in FIG. 1. In FIG. 2 the terminal C is coupled through a resistor 50 to the base of an NPN transistor 51 having its emitter connected to ground. The collector of the transistor 51 is coupled to the positive supply terminal 16 through a resistor 52 and to the negative input terminal of an operational amplifier 53 through a resistor 54. A positive input terminal of the amplifier 53 is connected to ground through a resistor 55 and to the positive supply terminal 16 through a resistor 56. The output of the operational amplifier 53 is directly connected to the terminal D and also connected to its negative input terminal through an integrating capacitor 57. Essentially, FIG. 2 merely represents another embodiment of the dual slope rate changing circuit 13.

In FIG. 1, the resistor 28 determines the amount of charging current contributed by the constant current source comprising the elements 27–29 while resistor 24 determines the discharging current produced by the constant current source comprising the elements 23–25. Actually, in the embodiment of the dual rate change circuit 13 in FIG. 1, the discharging current for the capacitor 26 is the current determined by the resistor 24 minus the current determined by the resistor 28, whereas the charging current for the capacitor is just the current determined by the resistor 28. The charging current determines the slope $k_2$, whereas the discharging current determines the slope $k_1$. In the embodiment of the dual slope circuit 13 shown in FIG. 1, it was found that if resistor 28 had a magnitude of 150 k ohms and resistor 24 had a magnitude of 50 k ohms, then the charging and discharging currents would be properly related so as to divide the input signal period T into one-third and two-thirds portions.

In the embodiment shown in FIG. 2, in response to the low logic state 37 being produced at the terminal C, the transistor 51 is turned off and the capacitor 57 is charged at a rate determined by the series resistance of the resistors 52 and 54. When the positive high logic state 38 is present at the terminal C, the transistor 51 is turned on and the capacitor 57 is discharged by a current essentially determined only by the magnitude of the resistor 54. By having resistor 52 equal to a 100k and resistor 54 equal to 50k, the circuit 13 in FIG. 2 will function substantially identically as the circuit 13 in FIG. 1. The feedback connection of a capacitor from the output of an operational amplifier to its input in order to implement an integrating circuit is well known to those skilled in the art.

Figure 3:
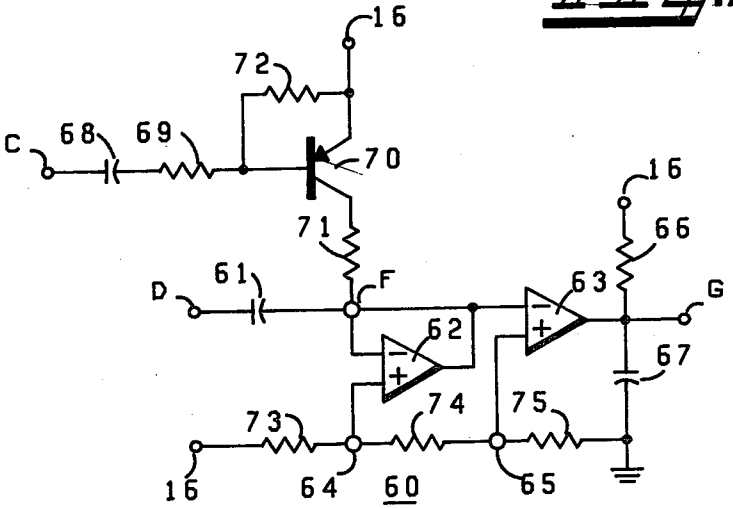
FIG. 3 is a schematic diagram illustrating an ignition dwell circuit for an internal combustion engine which utilizes the waveforms developed by the circuit in FIG. 1.

FIG. 3 illustrates circuitry 60 which when combined with the signal generator 10 illustrated in FIG. 1 produces an ignition dwell circuit for an internal combustion engine. In general, the circuit 60 utilizes waveforms developed by the signal generator 10 to produce pulses which occur at a precise fixed time before the occurrence of each of the crankshaft sensing position pulses 32. Thus the pulses produced by the circuit 60 can be used to initiate the dwell period for the spark coil of an internal combustion engine at a fixed time before predetermined angular positions of the engine crankshaft which are used to trigger spark ignitions. This is beneficial since at low engine speeds this will prevent excessive dwell times from occurring which would unnecessarily drain the battery and reduce spark plug and ignition coil life.

FIG. 3 illustrates that the output terminal D of the dual slope rate changing circuit 13 is coupled through a capacitor 61 to a terminal F which is directly connected to the negative input terminals of first and second comparators 62 and 63, respectively. The positive input terminal of the comparator 62 is connected to a reference terminal 64 and the output of the comparator 62 is directly connected to the terminal F. The positive input terminal of the comparator 63 is connected to a reference terminal 65 and the output of this comparator is directly connected to an output terminal G coupled to the positive supply terminal 16 through a resistor 66 and coupled to ground through a high frequency bypass capacitor 67. The output of the bistable flip-flop circuit 12 produced at the terminal C is coupled through a differentiating capacitor 68 in series with a resistor 69 to the base of a PNP transistor 70 having its emitter directly connected to the positive supply terminal 16 and its collector connected to the terminal F through a resistor 71. A resistor 72 is connected between the emitter and base electrodes of the transistor 70 and provides a bias return for the transistor. A voltage divider network is coupled between the positive supply terminal 16 and ground and comprises a resistor 73 connected between the terminals 16 and 64, a resistor 74 connected between the terminals 64 and 65 and a resistor 75 connected between terminal 65 and ground.

Essentially, the circuit 60 in FIG. 3 comprises a signal clamping means consisting of the capacitor 61, the comparator 62 and the components 68-71 connected in cascade with the comparator 63 which compares the clamped signal to a reference level and produces an output signal at the terminal G. This output signal comprises a pulse which will occur at a fixed time before the occurence of the crankshaft position sensing pulses 32 at the times $t_0$ regardless of the rotational speed of the crankshaft of the engine.

The circuit 60 operates in the following manner. The signal generator circuit 10 functions as described above to produce the signals 36 and 40 illustrated in FIGS. 5C and 5D. Thus the crankshaft position sensor 11 still produces a sensing signal 31 having periodic pulses 32 which occur at predetermined rotational positions of the engine crankshaft. Circuitry, comprising the flip-flop circuit 12, the dual slope integrator 13 and the comparator 14, receives these sensor signal pulses and produces the time varying signal 40, which for the purposes of the circuit 60 can be described as a dual ramp (saw-toothed) signal that changes at a predetermined rate $k_2$ immediately prior to the occurrence, at $t_0$, of each of the periodic pulses 32, and the signal 40 reaches a variable peak magnitude $V_f$ at the occurrence $t_0$ at each of the periodic sensor pulses 32. The signal generator 10 provides this ramp signal 40 at the terminal D of the circuit 60 shown in FIG. 3.

The capacitor 61 effectively couples the ramp signal 40 to the terminal F but does not preserve the DC levels of the signal 40. The comparator 62 effectively compares the signal at the terminal F to a first reference level voltage provided at the terminal 64 by the divider network 73-75. Thus the comparator 62, since its output is directly connected to the terminal F will positively prevent the voltage at the terminal F from ever exceeding the voltage at the terminal 64, since if that were to occur the voltage at the terminal F would be decreased since the output of the comparator 62 would be instantaneously pulled toward ground. As long as the voltage at terminal F exceeds the voltage at terminal 64, the output of the comparator 62 will be essentially free floating and the comparator 62 will not affect the voltage at terminal F. Thus the comparator 62 operates as an OPEN collector comparator.

The capacitor 68 receives the signal 36 at the terminal C and effectively provides a negative impulse at the base of the transistor 70 which momentarily turns on this transistor at the time $t_0$ which corresponds to the occurrence of the crankshaft position pulses 32. This effectively attempts to raise the potential at the terminal F to the positive supply voltage at the terminal 16 at each time $t_0$.

Thus the components 68-72 effectively insure that the signal produced at the terminal F will have at least a magnitude equal to the first reference level voltage at the terminal 64 at the occurrence of the sensor pulses 32 at the times $t_0$, while the comparator 62 effectively insures that the magnitude of the signal at the terminal F will never exceed the reference level at the terminal 64. The net effect of these components is to produce a clamped ramp signal 76 at the terminal F, wherein this clamped signal 76 varies identically to the variation of the ramp signal 40 but has its positive peak magnitudes clamped to the first predetermined reference voltage 64.

FIG. 5F illustrates the waveform of the signal 76 which is created in response to applying the waveform of the signal 40 shown in FIG. 5D to the terminal D. FIG. 5F illustrates that the positive peak magnitudes of the waveform 76 are clamped to a first predetermined reference level designated by the numeral 64 which corresponds to the voltage at the terminal 64. FIG. 5F also illustrates that, regardless of the period of the crankshaft position sensor pulses, the peak magnitudes of the waveform 76 will correspond to the reference level 64 and these peak magnitudes will occur at the time $t_0$. The signal 76 is also shown to be varying at the identical constant predetermined rates $k_1$ and $k_2$ as the unclamped signal 40. This is because the voltage across the capacitor 61 cannot change instantaneously, thus the waveform at the terminal F will follow the variations in the waveform at the terminal D.

The comparator 63 receives the clamped signal 76 and compares it to a second predetermined reference voltage at the terminal 65 which is offset from the first predetermined reference voltage at the terminal 64 by a predetermined constant amount. When the magnitude of the clamped signal 76 equals or exceeds this second reference level 65, the output of the comparator 63 is forced to a high logic state 77, whereas when the magnitude of the signal 76 does not exceed the level 65, the output of the comparator 63 is forced to a low logic state 78 corresponding to ground potential. In FIG. 5G a signal 79 is illustrated which corresponds to the output of the comparator 63 and comprises the logic states 77 and 78.

The transitions of the signal 79 from the logic state 78 to the logic state 77 occur at times $t_2$ which always occur at a constant time before the occurrence of the times $t_0$ that correspond to the production of the crankshaft position sensor pulses 32. Thus the waveform 79 represents a signal in which a logic state transition from the states 78 to 77 occurs at a fixed time before the occurrence of the crankshaft position pulses 32. The time duration between the times $t_2$ and $t_0$ can be shown to be constant regardless of the speed of rotation of the engine crankshaft. Thus the signal 79 can be used to initiate the dwell for an internal combustion engine at a fixed time before the production of a crankshaft position sensing pulse. The fact that the time interval from $t_2$ to $t_0$ is constant can be shown by remembering that the positive peaks of the signal 76 occur at the times $t_0$ and that the transition between the logic state 78 and the logic state 77 occurs while the signal 76 is varying at a constant rate $k_2$ immediately prior to reaching the peak value of the signal 76 at the time $t_0$. In one embodiment of the present invention, the time between $t_2$ and $t_0$ was maintained at 6 milliseconds over a 1,000 to 6,000 RPM range of engine speed crankshaft rotation.

Figure 4:
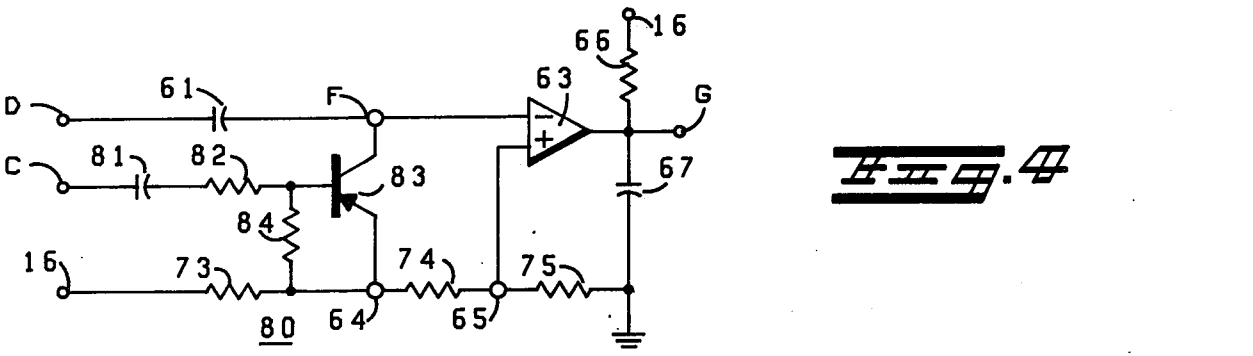
FIG. 4 is a schematic diagram of an alternate embodiment of the circuit illustrated in FIG. 3.

FIG. 4 illustrates another embodiment of the circuit 60 illustrated in FIG. 3. The circuit in FIG. 4 is identified by the reference numeral 80 and is identical to the circuit 60 except that the components 62 and 68 through 72 have been deleted and replaced by alternate circuitry. This alternate circuitry consists of a capacitor 81 in series with a resistor 82 connected between the terminal C' and the base of a PNP transistor 83 having its emitter electrode directly connected to the terminal 64, its collector electrode directly connected to the terminal F and its base electrode connected to the terminal 64 through a resistor 84. All of the signals produced at the terminals C, D, F and G in circuit 80 are identical to the signals at the identical reference terminals in the circuit 60.

Essentially, the circuit 80 utilizes the negative transition of the signal 36 present at the terminal C' (which occurs only at the times $t_0$) to create a negative impulse at the base of the transistor 83 that results in momentarily turning on the transistor 83, thus momentarily connecting the terminal F to the terminal 64. Thus the components 81–84 in FIG. 4 essentially force the magnitude of the waveform at the terminal F to coincide to the magnitude of the reference voltage at the terminal 64 at the times $t_0$. Since the signal 76 at the terminal F will have its peak magnitudes at the times $t_0$, the capacitor 61 together with the components 81–84 effectively clamp the peak magnitudes of the signal 76 to the reference level 64. In all other respects, the operation of the circuit 80 is identical to that of the circuit 60.

While we have shown and described a specific embodiment of this invention, further modifications and improvements will occur to those skilled in the art. All modifications which retain the basic underlying principles disclosed and claimed herein are within the scope of this invention.

We claim:

1. An ignition dwell circuit for an internal combustion engine, comprising:

sensor means for producing a sensor signal having periodic pulses occurring at predetermined rotational positions of an engine crankshaft;

means coupled to said sensor means for receiving said sensor signal pulses and producing, in response thereto, a ramp signal changing at a predetermined rate immediately prior to and reaching a variable peak magnitude at the occurrence of each of said periodic pulses;

clamp means for receiving said ramp signal and producing a corresponding similarly varying clamped ramp signal having a corresponding clamped peak magnitude clamped to a first predetermined reference level; and comparator means coupled to said clamp means for receiving said clamped signal and comparing it to a second predetermined reference level which is offset from said first predetermined reference level, wherein said clamped signal equals said second reference level a fixed time before the occurrence of said clamped peak magnitude and said comparator means produces a pulse in response thereto, whereby said comparator pulses occur a fixed time before said predetermined rotational positions of the engine crankshaft and can be used to initiate the dwell time for an internal combustion engine.

2. An ignition dwell circuit according to claim 1 wherein said variable peak magnitude of said ramp signal is related to the period of said sensor signal pulses.

3. An ignition dwell circuit according to claim 2 wherein said clamp means comprises a capacitor having a first terminal for receiving said ramp signal and a second terminal at which said clamped ramp signal is produced, said second terminal selectively coupled to said first predetermined reference level by a biasing means which directly couples said second terminal to said first reference level at the occurrence of each of said periodic pulses.

4. An ignition dwell circuit according to claim 3 wherein said first and second reference levels are determined by the voltages produced at various junctions in a voltage divider network serially connected between two reference potentials.

5. An ignition dwell circuit according to claim 1 wherein said first and second reference levels are determined by the voltages produced at various junctions in a voltage divider network serially connected between two reference potentials.

6. An ignition dwell circuit according to claim 2 wherein said clamp means comprises a capacitor having a first terminal for receiving said ramp signal and a second terminal at which said clamped signal is produced, said clamp means including a comparator having an input and an output terminal coupled to said second terminal and another input terminal coupled to said first reference level wherein said comparator prevents the voltage at said second terminal from exceeding said first reference level.

7. An ignition dwell circuit according to claim 6 wherein said clamp means includes selective bias means for setting said second terminal at said first reference level at the occurrence of each of said periodic pulses by attempting to raise the voltage at said second terminal above said first reference level at the occurrence of each of said periodic pulses.

8. A dwell circuit for an ignition system including:

means for producing a periodic input signal varying at a predetermined rate and having a variable peak magnitude which occurs at predetermined rotational positions of the crankshaft of an engine;

clamping means for receiving said input signal and producing a similarly varying clamped signal in which the corresponding peak magnitude of the clamped signal is clamped to a first reference level; and comparator means for receiving said clamped signal and comparing it with a second reference level offset from said first reference level so as to produce an output transition at an output of said comparator means during the varying of said input signal at said predetermined rate at a fixed time before the occurrence of said peak magnitude of said input signal, said output transition being used to initiate dwell for an ignition system.

* * * * *